US010712691B1

(12) United States Patent
Endo

(10) Patent No.: US 10,712,691 B1
(45) Date of Patent: Jul. 14, 2020

(54) FIXING DEVICE AND IMAGE FORMING APPARATUS

(71) Applicant: TOSHIBA TEC KABUSHIKI KAISHA, Shinagawa-ku, Tokyo (JP)

(72) Inventor: Sasuke Endo, Chigasaki Kanagawa (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/507,071

(22) Filed: Jul. 10, 2019

(30) Foreign Application Priority Data

Dec. 21, 2018 (JP) ..... 2018-239747

(51) Int. Cl.
*G03G 15/20* (2006.01)

(52) U.S. Cl.
CPC ..... *G03G 15/2025* (2013.01)

(58) Field of Classification Search
CPC ..... G03G 15/2025
See application file for complete search history.

(56) References Cited

U.S. PATENT DOCUMENTS 8,897,688 B2 11/2014 Hasegawa
2009/0274496 A1* 11/2009 Okamoto ..... G03G 15/2025 399/325
2010/0150623 A1* 6/2010 Matsumoto ..... G03G 15/2053 399/329
2010/0290822 A1 11/2010 Hasegawa et al.
2013/0195523 A1 8/2013 Yamaji et al.
2014/0119787 A1* 5/2014 Hasegawa ..... G03G 15/2053 399/329
2018/0059597 A1* 3/2018 Yamagishi ..... G03G 15/2025
2018/0150002 A1 5/2018 Soeda

FOREIGN PATENT DOCUMENTS

JP 2012-168484 9/2012
JP 2015-041005 3/2015

OTHER PUBLICATIONS

Extended European Search Report for European Patent Application No. 19192626.0 dated Apr. 9, 2020.

* cited by examiner

*Primary Examiner* — Sandra Brase
(74) *Attorney, Agent, or Firm* — Amin, Turocy & Watson, LLP

(57) ABSTRACT

In accordance with an embodiment, a fixing device for fixing a toner image formed on a medium to the medium comprises a heating rotating member that is rotatably supported; a heater configured to heat the heating rotating member; a pressing member arranged at the inside of the heating rotating member and configured to abut against an inner peripheral surface of the heating rotating member; a pressing rotating member configured to be pressed against the pressing member across the heating rotating member to form a nip through which the medium passes; a support member configured to movably support the pressing member in a direction orthogonal to a rotation axis of the pressing rotating member; and a lubricant supply member arranged between the support member and the pressing member and impregnated with a lubricant.

20 Claims, 16 Drawing Sheets

FIXING DEVICE AND IMAGE FORMING APPARATUS

CROSS-REFERENCE TO RELATED APPLICATION

This application is based upon and claims the benefit of priority from Japanese Patent Application No. 2018-239747, filed Dec. 21, 2018, the entire contents of which are incorporated herein by reference.

FIELD

Embodiments described herein relate generally to a fixing device and an image forming apparatus.

BACKGROUND

An image forming apparatus such as a multi-function peripheral or a laser printer includes a fixing device for fixing a toner image to a sheet. The fixing device fixes a toner image transferred onto a sheet to the sheet by applying heat generated by a heater to the sheet via a fixing belt, for example. In this way, an image or a character can be printed on the sheet.

In such a fixing device, a pressing roller is pressed via the fixing belt towards a pressing pad arranged at the inner side of the fixing belt, thereby forming a nip through which a sheet passes between the fixing belt and the pressing roller. Therefore, at the time the sheet passes through the nip, as the fixing belt and the pressing roller rotate, an inner peripheral surface of the fixing belt slides with respect to the pressing pad. For this reason, a lubricant such as silicone oil is applied to the inner peripheral surface of the fixing belt. In some cases, a sheet with low frictional resistance is arranged between the fixing belt and the pressing pad. In this way, the frictional resistance between the fixing belt and the pressing pad is reduced.

However, since silicone oil is reduced due to leakage from an end of the fixing belt, sliding property of the fixing belt and the pressing pad is weakened as the device operates. Therefore, various technologies are proposed to suppress reduction in the sliding property of the fixing belt and the pressing pad. In such a technology, the lubricant is applied to the surface of the fixing belt by supporting a lubricant supply member such as a felt impregnated by the lubricant in such a manner that the lubricant supply member slides on the surface of the rotating fixing belt.

DESCRIPTION OF THE DRAWINGS

FIG. 7 is a diagram illustrating a support member in a state of omitting a base member and the like;

DETAILED DESCRIPTION

In accordance with an embodiment, a fixing device for fixing a toner image formed on a medium to the medium comprises a heating rotating member that is rotatably supported; a heater configured to heat the heating rotating member; a pressing member arranged at the inside of the heating rotating member and configured to abut against an inner peripheral surface of the heating rotating member; a pressing rotating member configured to be pressed against the pressing member across the heating rotating member to forma nip through which the medium passes; a support member configured to movably support the pressing member in a direction orthogonal to a rotation axis of the pressing rotating member; and a lubricant supply member arranged between the support member and the pressing member and impregnated with a lubricant.

First Embodiment

An image forming apparatus according to the first embodiment is described below with reference to the accompanying drawings. In the following description, an XYZ coordinate system composed of X, Y and Z axes orthogonal to one another is used as appropriate.

Figure 1:
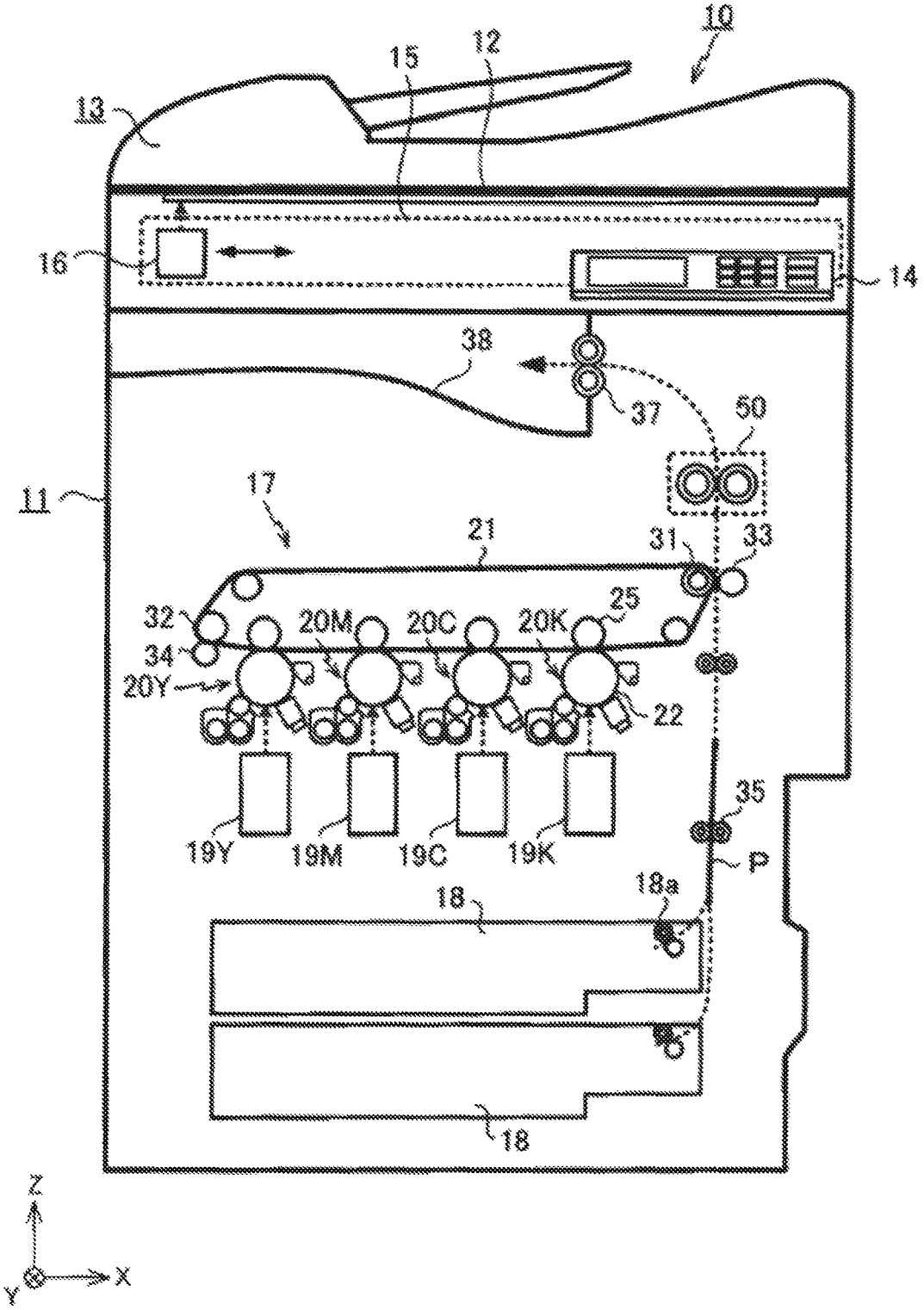
FIG. 1 is a view schematically illustrating a configuration of an image forming apparatus according to a first embodiment.

FIG. 1 is a view schematically illustrating a configuration of an image forming apparatus 10 according to the present embodiment. The image forming apparatus 10 is, for example, an MFP (Multi-Function Peripheral). The image forming apparatus 10 includes a main body 11 and an automatic document feeder (ADF) 13 arranged above the main body 11. A document table 12 made of transparent glass is arranged on the top of the main body 11, and the automatic document feeder (ADF) 13 is provided at an upper surface side of the document table 12 to be rotatable in an undulating manner. An operation panel 14 is provided on the top of the main body 11. The operation panel 14 has various keys, a GUI (Graphical User Interface), and the like.

Below the document table 12, a scanner 15 for reading a document is provided. The scanner 15 reads a document fed by the automatic document feeder 13 or a document placed on the document table 12 to generate image data. The scanner 15 is provided with an image sensor 16.

At the time of reading an image of a document placed on the document table 12, the image sensor 16 reads the image of the document while moving in a +X direction along the document table 12. At the time of reading the image of the document fed to the document table 12 by the automatic document feeder 13, the image sensor 16 is fixed at a position shown in FIG. 1 and reads images of sequentially fed documents for each document.

An image forming section 17 is arranged in the main body 11. The image forming section 17 forms a toner image on an image receiving medium such as a sheet accommodated in a sheet feed cassette 18 based on image data read by the scanner 15 or image data created by a personal computer or the like.

The image forming section 17 includes image forming sections 20Y, 20M, 20C and 20K for forming a latent image using toners in yellow (Y), magenta (M), cyan (C) and black (K) colors, scanning heads 19Y, 19M, 19C and 19K respectively corresponding to the image forming sections, an intermediate transfer belt 21 and the like.

The image forming sections 20Y, 20M, 20C and 20K are arranged below the intermediate transfer belt 21. In the image forming section 17, the image forming sections 20Y, 20M, 20C and 20K are arranged side by side from a −X side to a +X side thereof. The scanning heads 19Y, 19M, 19C and 19K are arranged below the image forming sections 20Y, 20M, 20C and 20K, respectively.

Figure 2:
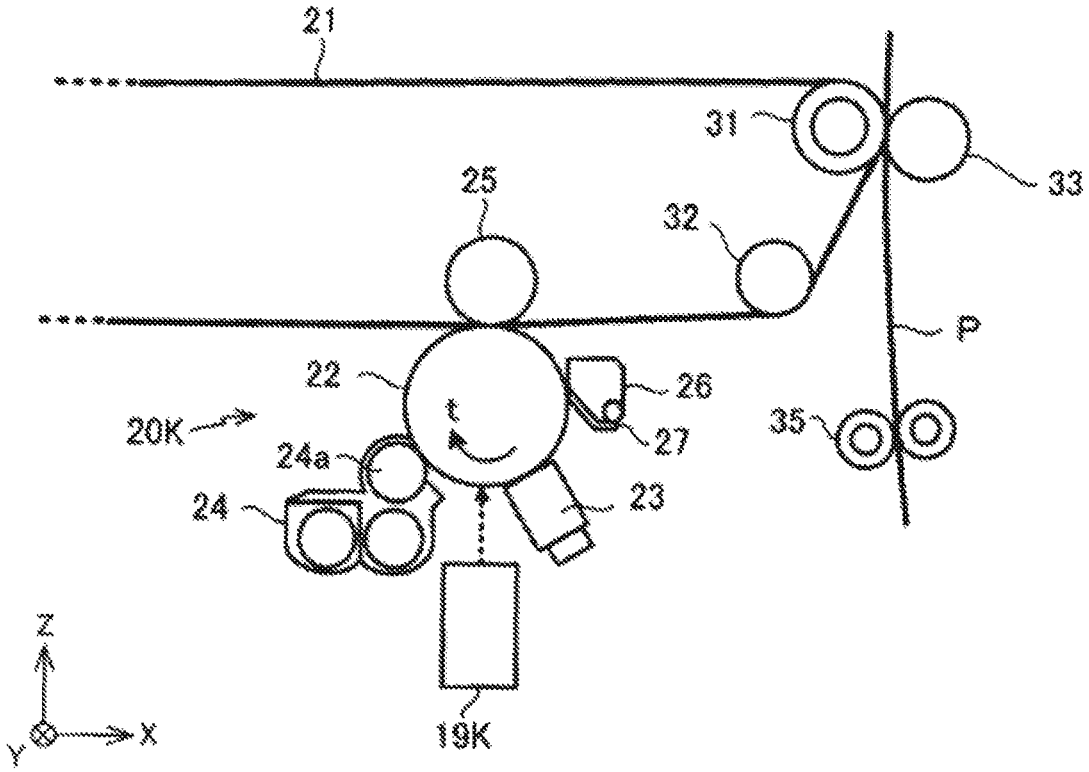
FIG. 2 is an enlarged view illustrating an image forming section.

FIG. 2 is an enlarged view illustrating the image forming section 20K among the image forming sections 20Y, 20M, 20C and 20K. The image forming sections 20Y, 20M, 20C and 20K have the same configuration. Therefore, the configuration of each image forming section is described by using the image forming section 20K as an example.

The image forming section 20K has a photoconductive drum 22 serving as an image carrier. Around the photoconductive drum 22, an electrostatic charger 23, an exposure device 24, a primary transfer roller 25, a cleaner 26 and the like are arranged in a direction indicated by an arrow t. A laser beam is emitted from the scanning head 19K to the exposure position of the photoconductive drum 22. By irradiating the surface of the rotating photoconductive drum 22 with the laser beam, an electrostatic latent image is formed on a surface of the photoconductive drum 22.

The electrostatic charger 23 of the image forming section 20K uniformly charges the surface of the photoconductive drum 22. The exposure device 24 supplies toner to the photoconductive drum 22 through a developing roller 24*a* to which a developing bias is applied to develop the electrostatic latent image. The cleaner 26 peels off residual toner on the surface of the photoconductive drum 22 using a blade 27 to remove the residual toner. The toner peeled off by the blade 27 is collected by the cleaner 26.

As shown in FIG. 1, the intermediate transfer belt 21 is stretched over a drive roller 31 and three driven rollers 32. The intermediate transfer belt 21 rotates counterclockwise as shown in FIG. 1 as the drive roller 31 rotates. As shown in FIG. 1, the intermediate transfer belt 21 contacts an upper surface of each photoconductive drum 22 of the image forming sections 20Y, 20M, 20C and 20K. A primary transfer voltage is applied by the primary transfer roller 25 to a position of the intermediate transfer belt 21 facing the photoconductive drum 22. As a result, the toner image developed on the surface of the photoconductive drum 22 is primarily transferred onto the intermediate transfer belt 21.

A secondary transfer roller 33 is arranged to face the drive roller 31 for stretching the intermediate transfer belt 21. At the time the sheet P passes between the drive roller 31 and the secondary transfer roller 33, the secondary transfer voltage is applied to the sheet P by the secondary transfer roller 33. As a result, the toner image formed on the intermediate transfer belt 21 is secondarily transferred onto the sheet P. In the vicinity of the driven roller 32 in the intermediate transfer belt 21, as shown in FIG. 1, a belt cleaner 34 is provided. The belt cleaner 34 removes residual toner on the surface of the intermediate transfer belt 21.

As shown in FIG. 1, a sheet feed roller 35 is provided between the sheet feed cassette 18 and the secondary transfer roller 33. The sheet P that a pickup roller 18*a* arranged in the vicinity of the sheet feed cassette 18 takes out of the sheet feed cassette 18 is conveyed between the intermediate transfer belt 21 and the secondary transfer roller 33 by the sheet feed roller 35.

A fixing device 50 is provided above the secondary transfer roller 33. A sheet discharge roller 37 is provided above the fixing device 50. The sheet P passing through the intermediate transfer belt 21 and the secondary transfer roller 33 is heated by the fixing device 50. As a result, the toner image is fixed to the sheet P. The sheet P passing through the fixing device 50 is discharged by the sheet discharge roller 37 to a sheet discharge section 38.

Figure 3:
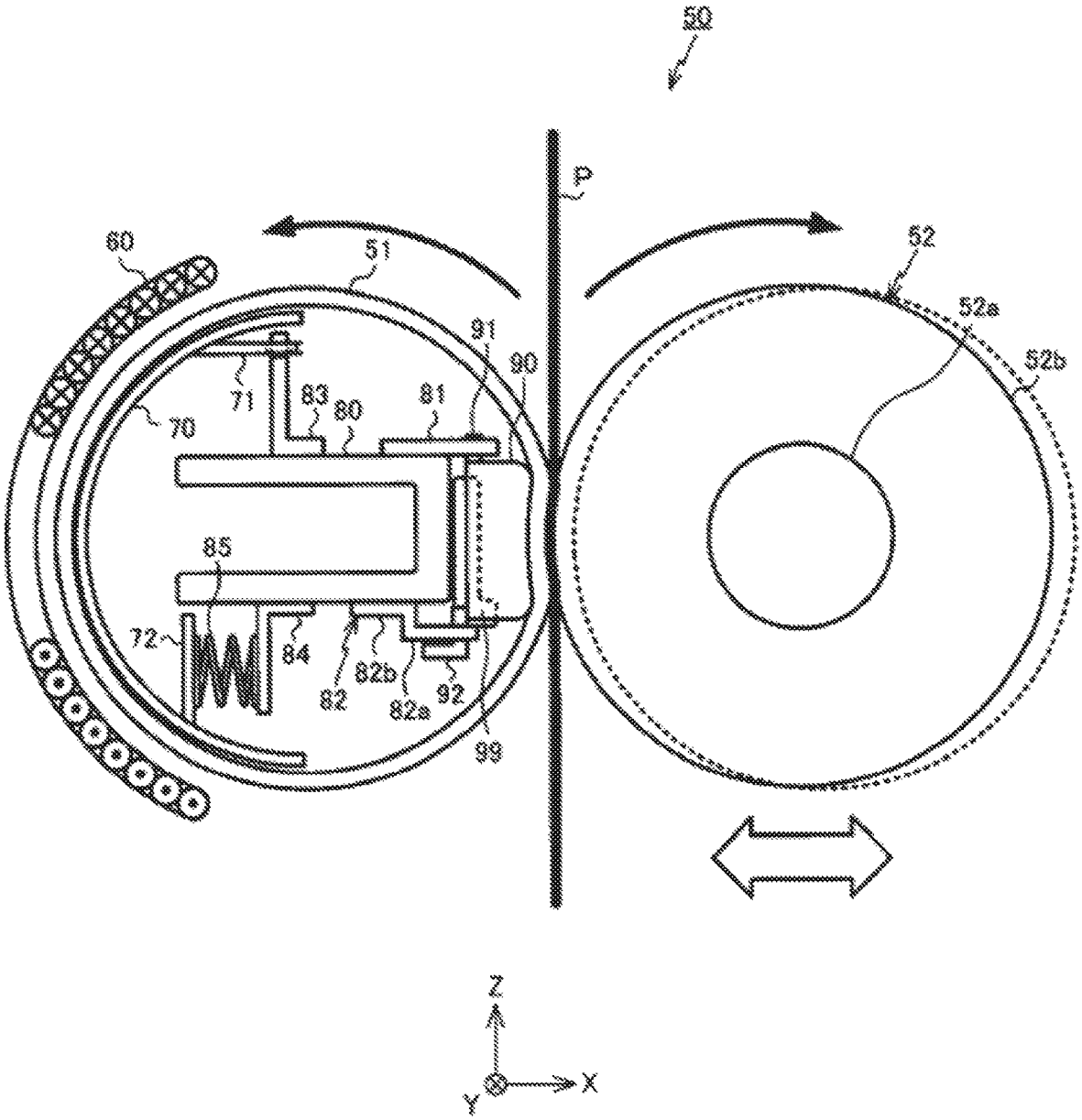
FIG. 3 is a diagram illustrating an example of a fixing device.

FIG. 3 is a diagram illustrating an example of the fixing device 50. The fixing device 50 includes a fixing belt 51, a pressing roller 52, a base member 80 arranged at the inner side of the fixing belt 51, a pressing pad 90 supported by the base member 80, a magnetic shunt member 70, a lubricant supply member 99 and a heating coil 60 arranged along an outer peripheral surface of the fixing belt 51.

The fixing belt 51 has a cylindrical shape extending in a Y axis direction, and a length thereof is larger than a width of the sheet P (dimension in the Y axis direction of the sheet P). A thickness of the fixing belt 51 is about 300 μm. A base material of the fixing belt 51 is a film made of polyimide with a thickness of 70 μm and having heat resistance. On the surface of the base material, for example, a heat generating layer, a multifunctional layer, an elastic layer, and a protective layer are stacked.

The heat generating layer is made of a metal such as copper or SUS, and the multifunctional layer is made of nickel. The elastic layer is made of silicon rubber having a thickness of about 200 μm. The elastic layer is covered with the protective layer made of PFA resin (perfluoroalkoxy fluorine resin) or the like. The elastic layer and the protective layer are adjusted in thickness so as to prevent a heat capacity from becoming too large due to reduction in a warm-up time of the fixing device 50.

The fixing belt 51 is rotatably supported around an axis parallel to the Y axis. Silicone oil serving as a lubricant is applied to the inner peripheral surface of the fixing belt 51.

The base member 80 has a U-shaped cross section and extends in the Y axis direction. The base member 80 has substantially the same length as the fixing belt 51, and is horizontally supported in parallel with the Y axis.

Figure 4:
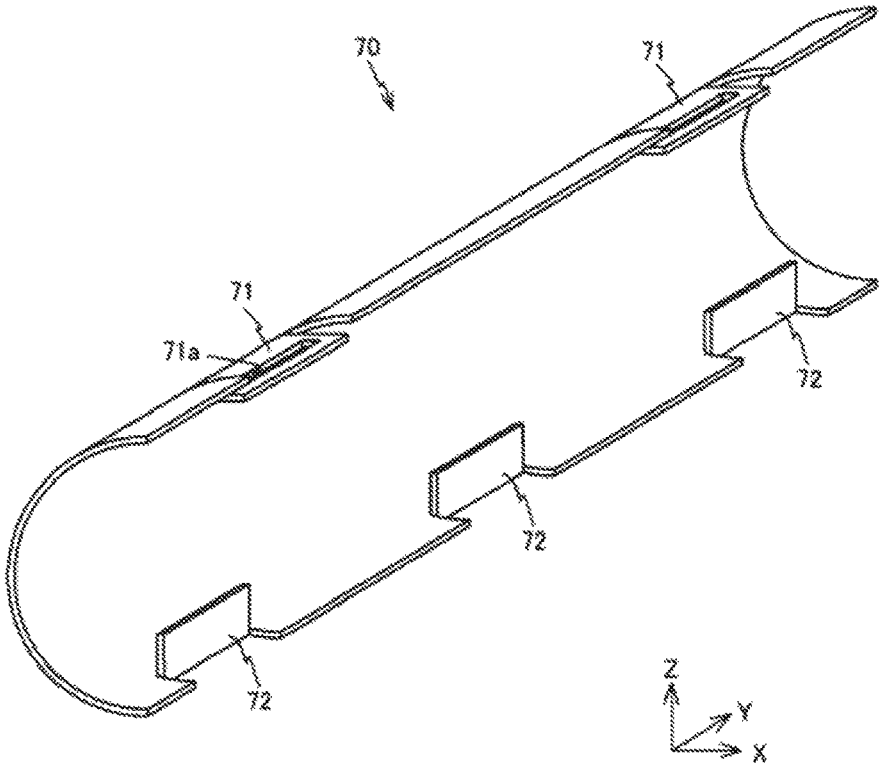
FIG. 4 is a perspective view illustrating a magnetic shunt member.

FIG. 4 is a perspective view illustrating the magnetic shunt member 70. The magnetic shunt member 70 has a semi-cylindrical shape and extends in the Y axis direction. The magnetic shunt member 70 is made of a magnetic shunt alloy of which magnetic permeability changes with temperature, and magnetic property of the magnetic shunt member 70 changes when heated to a temperature above the Curie temperature thereof. The Curie temperature of the magnetic shunt member 70 is about 200° C. although varying depending on use of the image forming apparatus 10 and the like. The magnetic shunt member 70 is made of, for example, an alloy of iron and nickel.

As shown in FIG. 4, at an upper end of the magnetic shunt member 70, for example, a pair of fixed portions 71 is formed. At the center of each fixed portion 71, a rectangular opening 71*a* extending in the Y axis direction is formed. At a lower end of the magnetic shunt member 70, for example, three abutting portions 72 are formed at equal intervals in the Y axis direction. Each abutting portion 72 is provided to be parallel to a YZ plane. The magnetic shunt member 70 provided with the fixed portion 71 and the abutting portion 72 can be integrally formed by, for example, performing a sheet-metal processing on a magnetic shunt alloy.

As shown in FIG. 3, the magnetic shunt member 70 is supported by a support member 83. The support member 83 is made of, for example, metal such as iron or SUS, and an upper end thereof is inserted into the opening 71*a* of the magnetic shunt member 70 to support the magnetic shunt member 70 in an XY plane so as to position the magnetic shunt member 70. The abutting portion 72 is energized in the −X direction by a pressure spring 85 of a support member 84, and in this way, the magnetic shunt member 70 abuts against the inner peripheral surface of the fixing belt 51.

Figure 5:
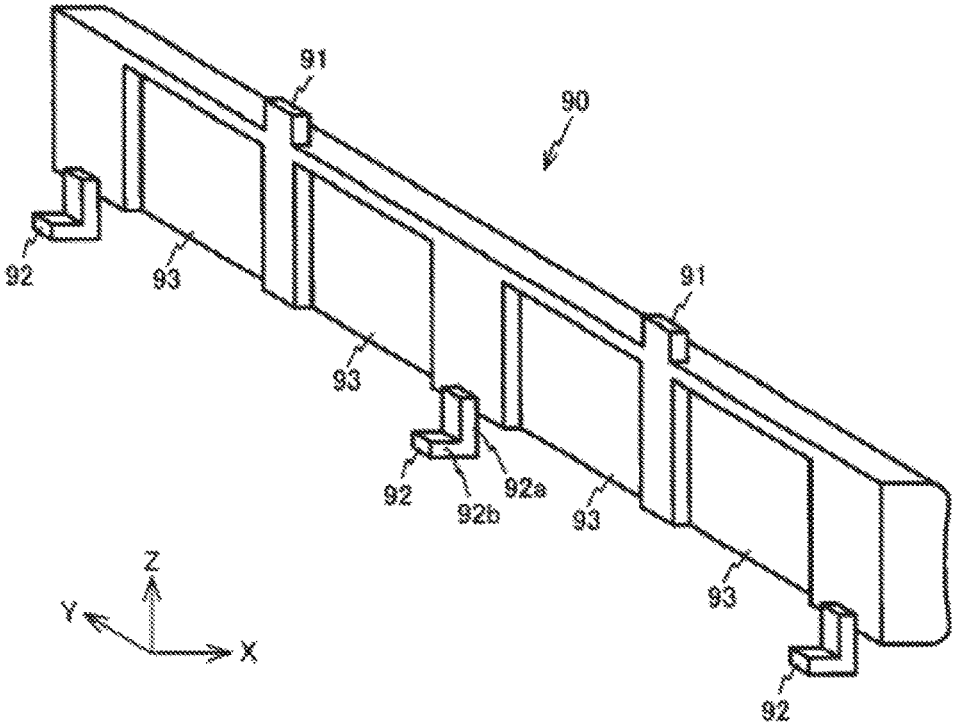
FIG. 5 is a perspective view illustrating a pressing pad.

Returning to FIG. 3, the pressing pad 90 internally supports the fixing belt 51 with respect to the pressing roller 52. FIG. 5 is a perspective view illustrating the pressing pad 90. As shown in FIG. 5, the pressing pad 90 extends in the Y axis direction. The pressing pad 90 is made of, for example, elastic material such as silicone rubber or fluorine rubber, or heat-resistant resin such as a polyimide resin, polyphenylene sulfide resin (PPS), polyether sulfone (PES), liquid crystal polymer (LCP), phenol resin (PF), etc.

For example, a pair of the pawls 91 is formed at an upper end of the pressing pad 90, and an L-shaped pawl 92 is formed at a lower end thereof. Four recesses 93 are formed on a surface of the pressing pad 90 on the −X side that faces a support member 82.

The pawl 91 protrudes upwards (in a +Z direction) from the upper end of the pressing pad 90, and has a rectangular parallelepiped shape. The pawl 91 includes a vertical portion 92*a* protruding downwards (in a −Z direction) from the lower end of the pressing pad 90, and a horizontal portion 92*b* extending in the −X direction from the vertical portion 92*a*.

Figure 6:
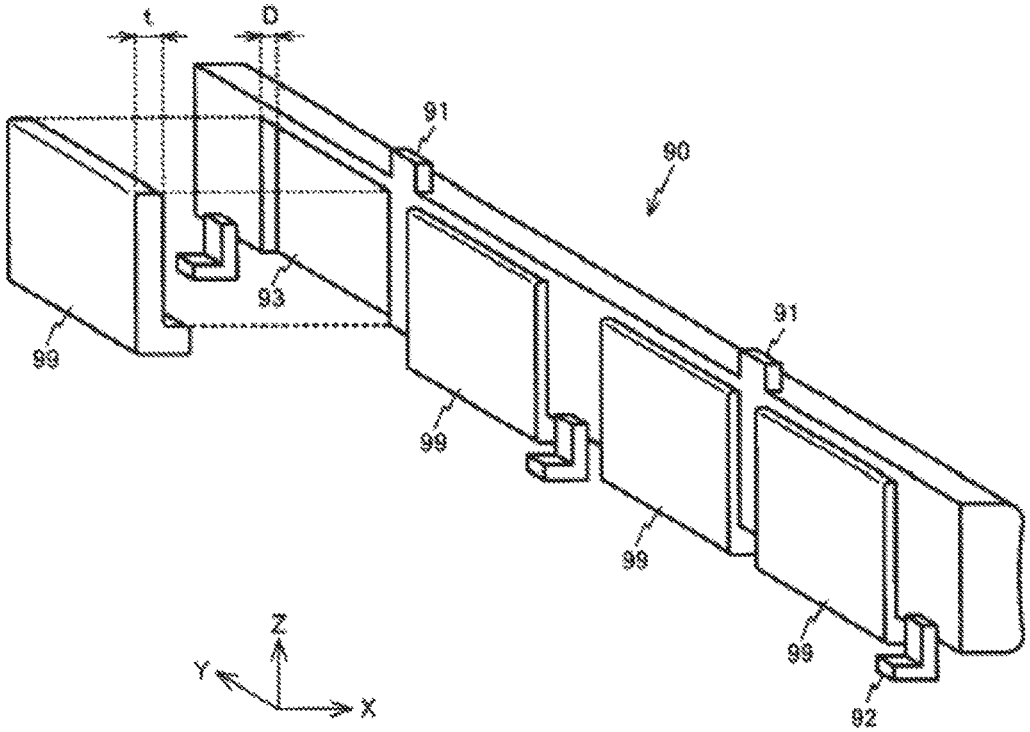
FIG. 6 is a perspective view illustrating the pressing pad and a lubricant supply member.

The four recesses 93 are arranged along the Y axis, and each recess 93 is formed from the upper end to the lower end of the surface of the pressing pad 90 on the −X side. Therefore, in the recess 93, inner wall surfaces are formed at both ends in the Y axis direction and on the +Z side end. FIG. 6 is a perspective view illustrating the pressing pad and the lubricant supply member 99. As shown in FIG. 6, the lubricant supply member 99 is arranged in the recess 93.

The lubricant supply member 99 is a quadrangular plate-like member that elastically deforms. The size of the lubricant supply member 99 in the Y axis direction is substantially equal to that of the recess 93 in the Y axis direction, and the size of the lubricant supply member 99 in the Z axis direction is slightly larger than that of the recess 93 in the Z axis direction. Therefore, when the lubricant supply member 99 is arranged in the recess 93, the lubricant supply member 99 is bent in such a manner that a lower end thereof forms a right angle. For example, the lubricant supply member 99 is bonded from a bottom wall surface (surface on the −X side) of the recess 93 to the lower surface of the pressing pad 90 with an adhesive or the like. The lubricant supply member 99 is made of, for example, a liquid absorbent material such as aramid fiber, melamine resin, glass fiber, and is impregnated with silicone oil in advance.

A thickness t of the lubricant supply member 99 is larger than a depth D of the recess 93. For this reason, as shown in FIG. 6, a half to one-third portion of the lubricant supply member 99 arranged in the recess 93 is in a state of protruding from a surface of the pressing pad 90 on the −X side.

As shown in FIG. 3, an upper end and a lower end of the pressing pad 90 to which the lubricant supply member 99 is attached are respectively supported by the support members 81 and 82 fixed to the base member 80 in such a manner that the pressing pad 90 is capable of reciprocating in the X axis direction.

Figure 7:
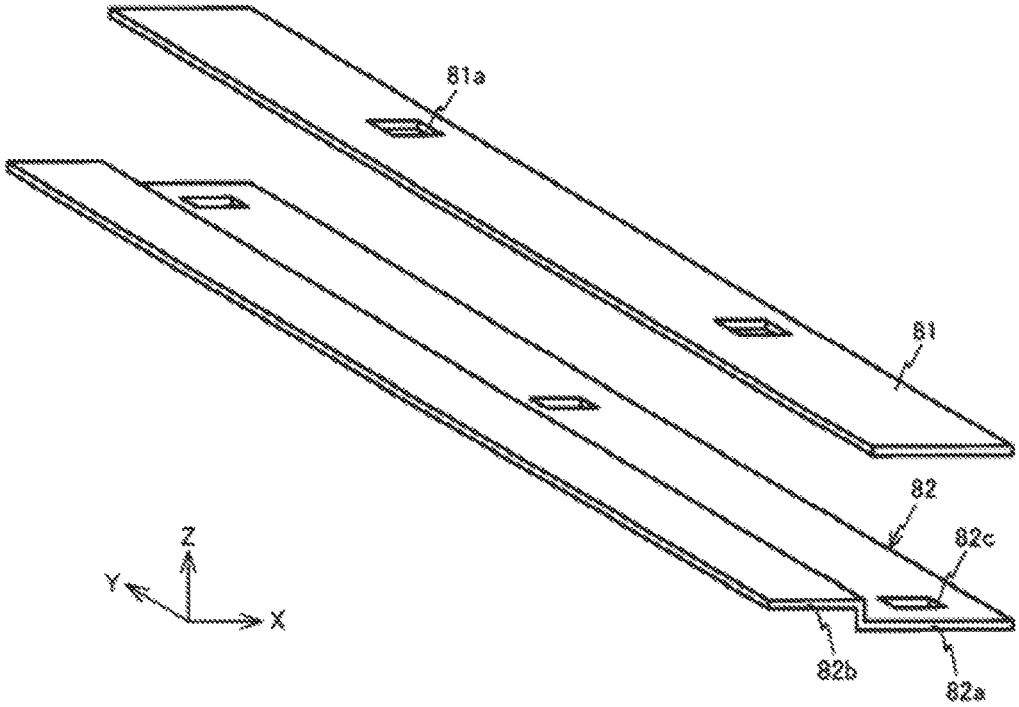

FIG. 7 is a diagram illustrating the support members 81 and 82 in a state in which the base member 80 etc. is omitted. As shown in FIG. 7, the support member 81 is a rectangular plate-like member extending in the Y axis direction. The support member 81 is made of, for example, iron or SUS, and has two rectangular openings 81*a* extending in the X axis direction. In a horizontal state, an end of the support member 81 on the −X side is fixed to the base member 80, for example, through a bolt or a screw, as shown in FIG. 3.

As shown in FIG. 7, the support member 82 extends in the Y axis direction, and is bent at the center thereof in the X axis direction to forma first portion 82*a* and a second portion 82*b* parallel to the XY plane. The first portion 82*a* includes three rectangular openings 82*c* extending in the X axis direction. As shown in FIG. 3, when the first portion 82*a* and the second portion 82*b* are in the horizontal state, the second portion 82*b* of the support member 82 is fixed to the base member 80, for example, through a bolt or a screw.

Figure 8:
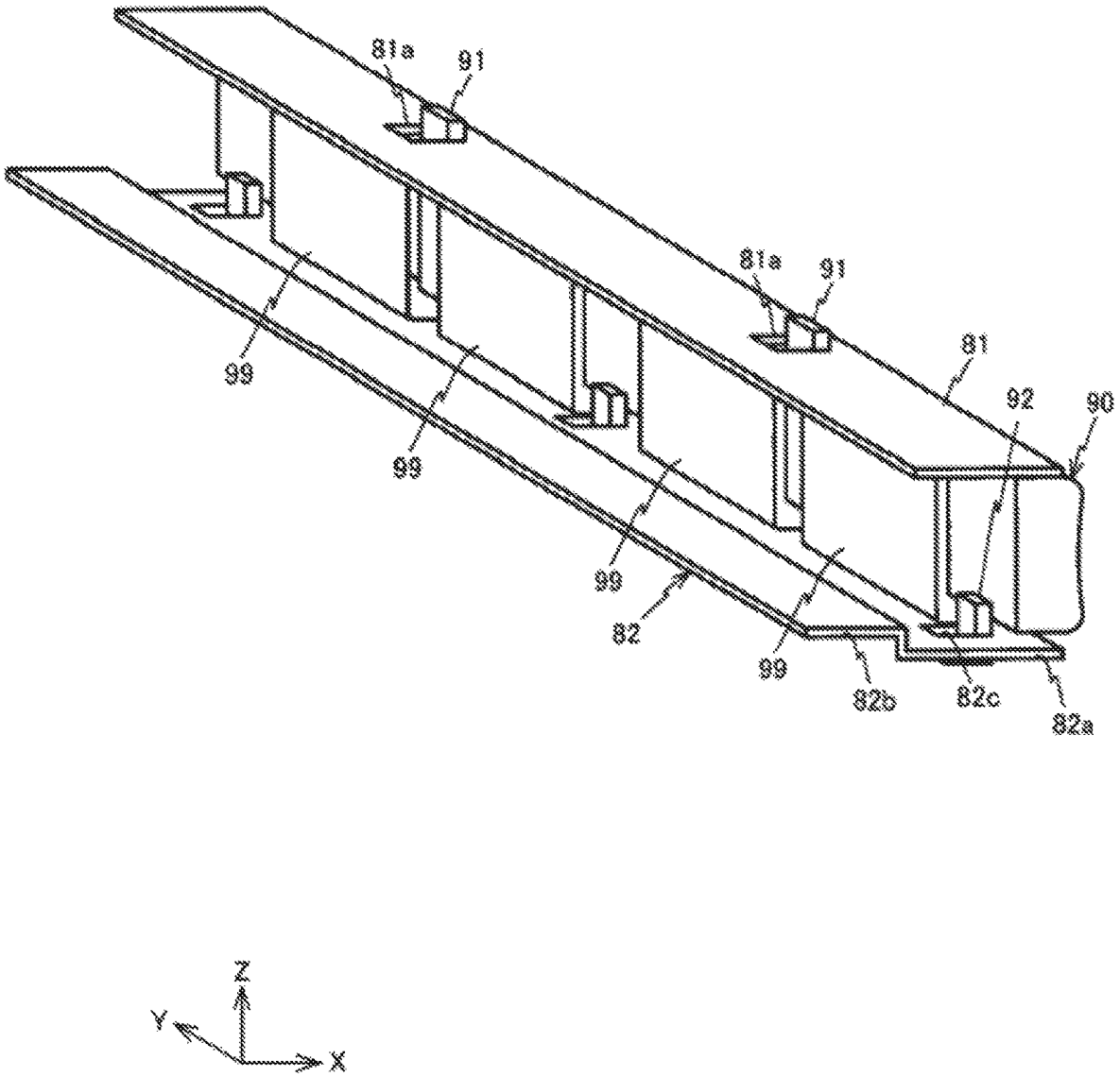
FIG. 8 is a perspective view illustrating a support member and the pressing pad.

As can be known with reference to FIG. 8, the pressing pad 90 is supported by the support members 81 and 82 in a state in which two pawls 91 are inserted into the openings 81*a* of the support member 81 and three pawls 92 are inserted into the openings 82*c* of the support member 82. For this reason, the pressing pad 90 reciprocates along the X axis within a range in which the pawls 91 and 92 can reciprocate in the openings 81*a* and 82*c* of the support members 81 and 82, respectively.

The pressing roller 52 shown in FIG. 3 is a cylindrical member extending in the Y axis direction. The pressing roller 52 includes a core 52*a* made of metal such as aluminum and a silicone rubber layer 52*b* stacked on an outer peripheral surface of the core. The surface of the silicone rubber layer 52*b* is coated with PFA resin (perfluoroalkoxy fluorine resin). The pressing roller 52 has an outer diameter of about 25 mm and a length approximately equal to the length of the fixing belt 51.

Figure 9:
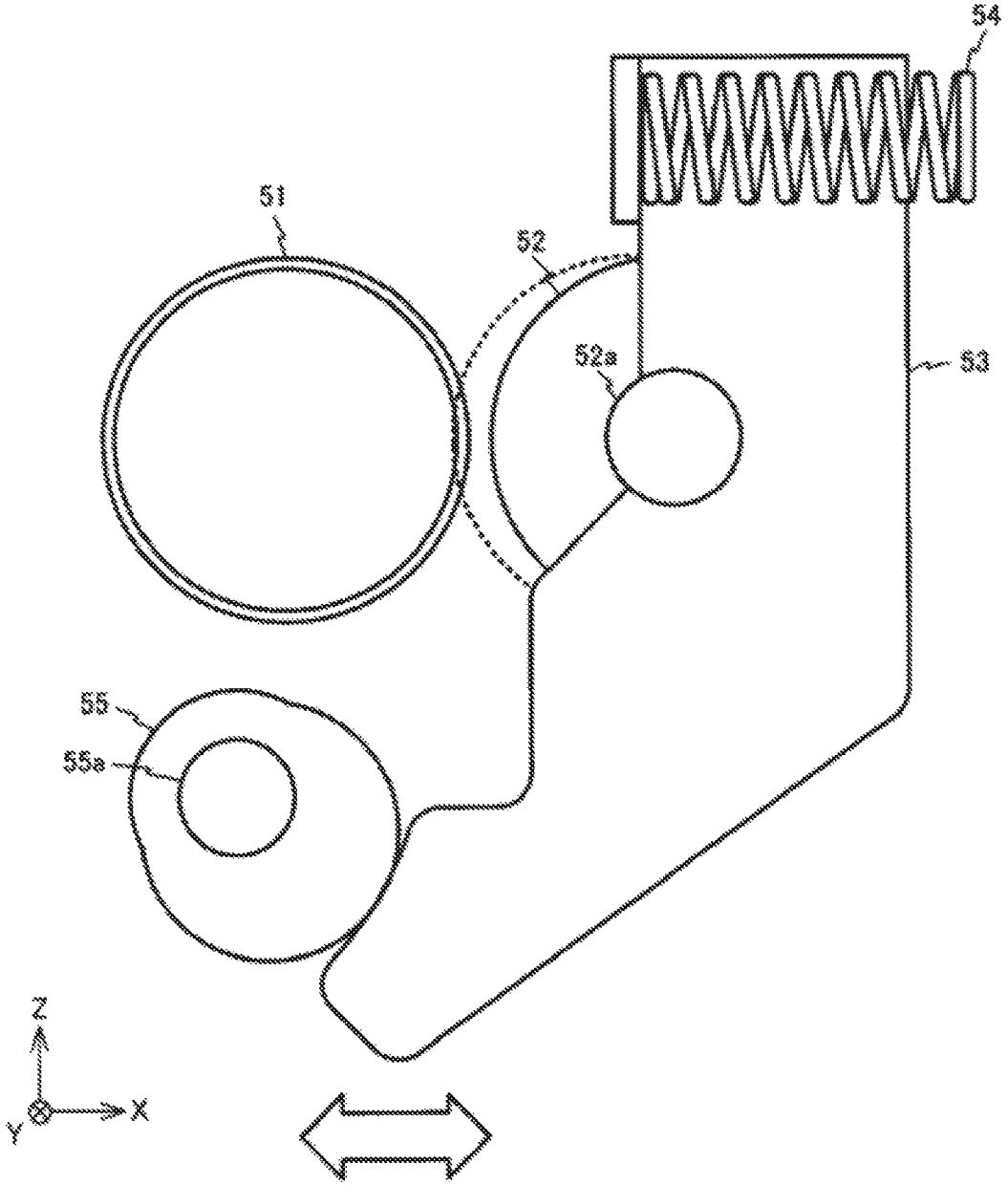
FIG. 9 is a diagram illustrating a movable arm 53 for supporting a pressing roller 52.

FIG. 9 is a diagram illustrating the pressing roller 52 and a movable arm 53 for supporting the pressing roller 52. In the fixing device 50, two movable arms 53 are respectively arranged on a +Y side and a −Y side of the pressing roller 52. Each movable arm 53 is movable in the X axis direction, and is energized by a spring 54 towards the −X direction. The movable arms 53 support both ends of the core 52*a* of the pressing roller 52 in the Y axis direction in such a manner that the both ends of the core 52*a* are rotatable around an axis parallel to the Y axis, respectively.

In the vicinity of the lower end of the movable arm 53, a cam 55 rotating around an axis 55*a* parallel to the Y axis is provided. The movable arm 53 is energized by the spring 54 so that a lower end of the movable arm 53 abuts against the cam 55 or the pressing roller 52 supported by the movable arm 53 abuts against the fixing belt 51, whereby the position of the movable arm 53 in the X axis direction is defined. In the state shown in FIG. 9, the movable arm 53 is positioned by enabling the lower end thereof to abut against the cam 55. In this state, the pressing roller 52 is separated from the fixing belt 51. The movable arm 53 reciprocates in the X axis direction as the cam 55 rotates. For this reason, the pressing roller 52 moves between a position where the pressing roller 52 is separated from the fixing belt 51, which is indicated by a solid line in FIG. 9, and a position where the pressing roller 52 contacts the fixing belt 51, which is indicated by a dashed line.

At the time the pressing roller 52 contacts the fixing belt 51, the pressing roller 52 is energized by the spring 54 towards the fixing belt 51. In this way, the pressing roller 52 is pressed against the pressing pad 90 across the fixing belt 51. Then, a surface of the pressing roller 52 closely contacts a surface of the fixing belt 51, thereby forming a nip through which the sheet P passes from the lower side to the upper side (in the +Z direction). At the time of not applying heat to the sheet P, the pressing roller 52 retracts to a standby position shown by a dotted line in FIG. 3.

When the fixing device 50 is in a standby state, the pressing roller 52 moves away from the fixing belt 51 to retract to the retraction position, thereby preventing the creep of the fixing belt 51.

Figure 10:
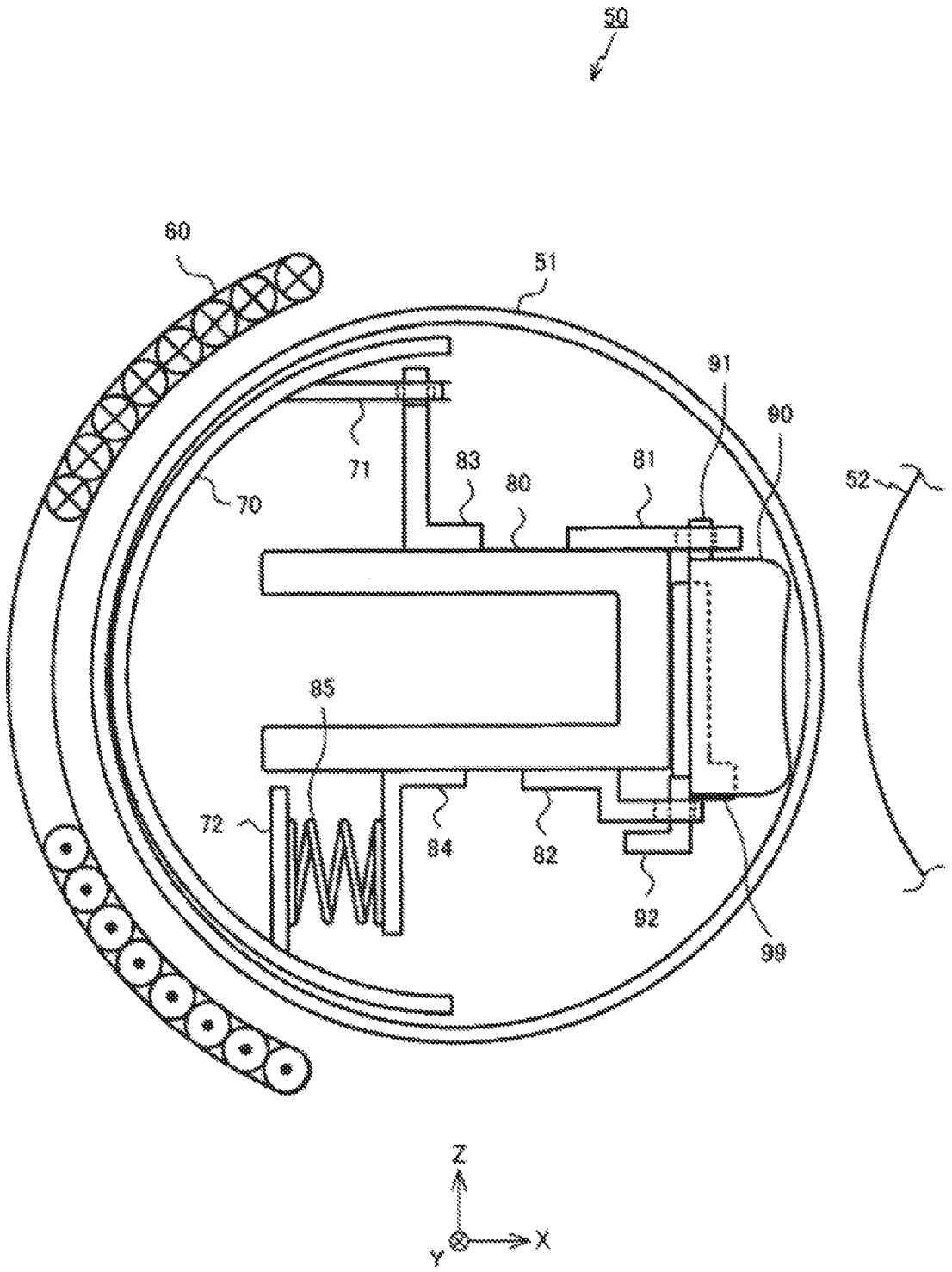
FIG. 10 is a diagram illustrating the fixing device at the time the pressing roller is positioned at a retraction position.

FIG. 10 is a diagram illustrating the fixing device 50 at the time the pressing roller 52 is located at the retraction position. In this state, the pressing roller 52 is separated from the fixing belt 51. The pressing pad 90 is located at a position separated from the base member 80 by an elastic force of the lubricant supply member 99. As long as the pressing roller 52 moves away from the fixing belt 51 and the pressing pad 90 is located at a position separated from the base member 80 due to the elastic force of the lubricant supply member 99, the pressing roller 52 may also contact the fixing belt 51 at the retraction position.

Figure 11:
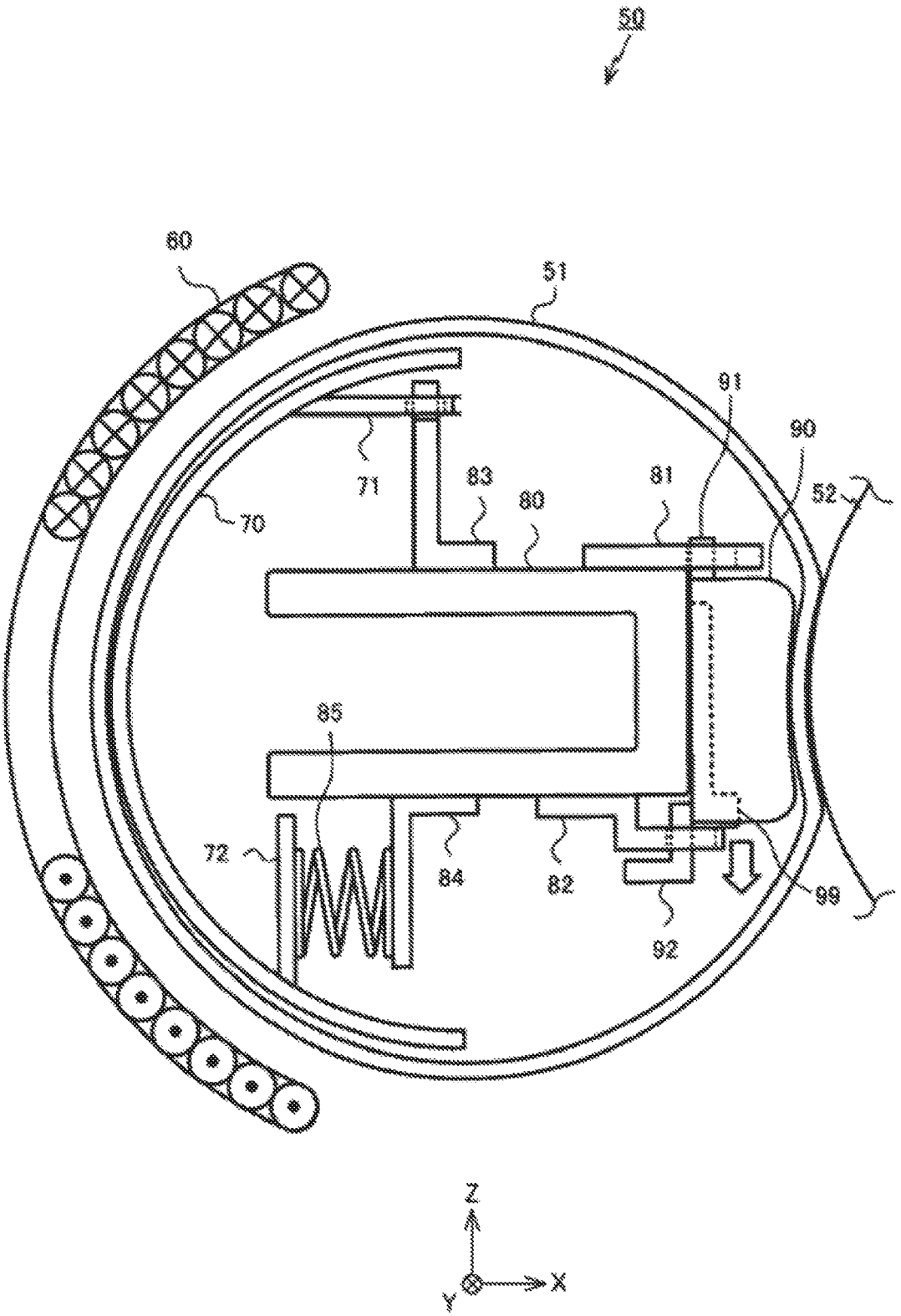
FIG. 11 is a diagram illustrating the fixing device at the time the pressing roller is positioned at an abutting position.

FIG. 11 is a diagram illustrating the fixing device 50 at the time the pressing roller 52 is located at an abutting position where the pressing roller 52 abuts against the pressing pad 90 across the fixing belt 51. As shown in FIG. 11, at the time the pressing roller 52 is located at the abutting position, the pressing pad 90 is pressed against the base member 80 by the pressing roller 52 so as to closely contact the base member 80. As a result, the lubricant supply member 99 located between the pressing pad 90 and the base member 80 contracts, and the lubricant impregnated in the lubricant supply member 99 exudes. Then, the exuding lubricant drops to the surface of the fixing belt 51, as indicated by a hollow arrow. Thereby, the lubricant is supplied to the inner peripheral surface of the fixing belt 51.

In the fixing device 50, every time the sheet P is heated, the pressing pad 90 is pressed against the base member 80 by the pressing roller 52, and the lubricant is supplied to the inner peripheral surface of the fixing belt 51.

The heating coil 60 is arranged along the outer peripheral surface of the fixing belt 51. The heating coil 60 faces the magnetic shunt member 70 across the fixing belt 51. A high frequency voltage is applied to the heating coil 60 by a fixing control circuit 150 described below. If the high frequency voltage is applied to the heating coil 60, an eddy current flows to the fixing belt 51 through electromagnetic induction, and the fixing belt 51 generates heat.

In the fixing device 50 described above, as the pressing roller 52 rotates, the sheet P passes through the nip between the pressing roller 52 and the fixing belt 51 that respectively rotate in directions indicated by the arrows in FIG. 3. As a result, the sheet P is heated by the fixing belt 51 that generates the heat, and the toner image formed on the sheet P is fixed to the sheet P.

Figure 12:
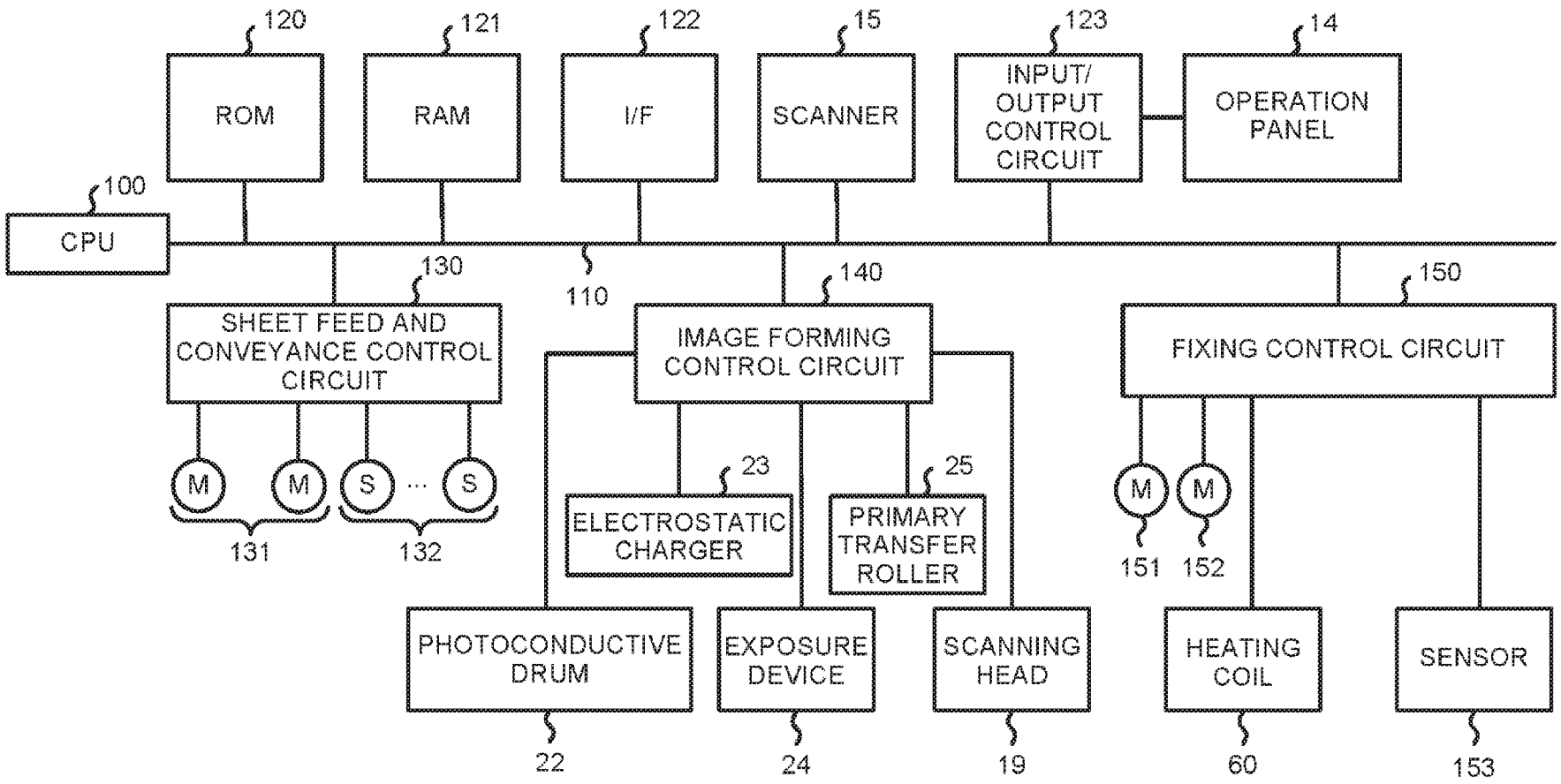
FIG. 12 is a block diagram illustrating a control system of the image forming apparatus.

FIG. 12 is a block diagram illustrating a control system of the image forming apparatus 10. The control system includes, for example, a CPU (Central Processing Unit) 100 that controls the entire image forming apparatus, a bus line 110, a ROM (Read Only Memory) 120, a RAM (Random Access Memory) 121, an interface 122, a scanner 15, an input/output control circuit 123, a sheet feed and conveyance control circuit 130, an image forming control circuit 140, and the fixing control circuit 150. The CPU 100 and each circuit are connected via the bus line 110.

The ROM 120 stores control programs, control data and the like for performing basic operations of the image forming process.

The RAM 121 functions as a working memory which is a working area of the CPU 100.

The CPU 100 executes programs stored in the ROM 120. In this way, the CPU 100 collectively controls the components of the image forming apparatus 10 to sequentially perform various processing for forming an image on the sheet.

The interface 122 establishes communication with a device such as a terminal used by a user. The input/output control circuit 123 displays information on the operation panel 14 and receives an input from the operation panel 14. A user of the image forming apparatus 10 can operate the operation panel 14 to designate, for example, a sheet size, the number of print copies of a document, and the like.

The sheet feed and conveyance control circuit 130 controls a motor group 131 that drives the pickup roller 18*a*, the sheet feed roller 35 or the sheet discharge roller 37 on a conveyance path of the sheet. The sheet feed and conveyance control circuit 130 controls the motor group 131 in response to a control signal from the CPU 100 or according to detection results from various sensors 132 provided in the vicinity of the sheet feed cassette 18 or provided on the conveyance path of the sheet.

The image forming control circuit 140 controls the photoconductive drum 22, the electrostatic charger 23, the scanning heads 19Y, 19M, 19C and 19K, the exposure device 24, and the primary transfer roller 25 in response to control signals from the CPU 100.

The fixing control circuit 150 controls a drive motor 151 that rotates the pressing roller 52 of the fixing device 50 in response to a control signal from the CPU 100, and controls a motor 152 that rotates the cam 55 at the same time to enable the pressing roller 52 to reciprocate between the standby position and the abutting position. In the fixing device 50, at the time of fixing an image to the sheet P, the pressing roller 52 moves to the abutting position; and at the time of waiting for fixing of an image to the sheet P in a standby state after termination of an image forming job, the pressing roller 52 moves to the standby position. The fixing control circuit 150 controls the motor 152 to change an attitude of the cam 55 to adjust the pressure by the pressing roller 52 against the fixing belt 51 according to a thickness and type of the sheet P. In parallel with the execution of the above operation, the fixing control circuit 150 drives the heating coil 60 based on an output from a sensor 153 for detecting the temperature of the fixing belt 51, a size of the sheet P notified from the CPU, etc.

In the image forming apparatus 10, an image forming processing for performing printing on the sheet P is performed in response to reception of a print command from the user. The image forming processing is performed, for example, to print the image data received via the interface 122 or to print the image data generated by the scanner 15.

Next, the image forming processing performed by the image forming apparatus 10 is described. The image forming apparatus 10 executes the image forming processing for forming an image on the sheet P if the print command is received from the user. In the image forming processing, as shown in FIG. 1, the sheet P is picked up from the sheet feed cassette 18 by the pickup roller 18*a*, and is then conveyed by the sheet feed roller 35 to a space between the intermediate transfer belt 21 and the secondary transfer roller 33. The pressing roller 52 of the fixing device 50 moves to the abutting position.

In parallel with the execution of the above operation, toner images are formed on the photoconductive drums 22 in the image forming sections 20Y, 20M, 20C and 20K, respectively. The toner images formed on the photoconductive drums 22 in the image forming sections 20Y, 20M, 20C and 20K are sequentially transferred onto the intermediate transfer belt 21. As a result, a toner image formed with yellow (Y) toner, magenta (M) toner, cyan (C) toner and black (K) toner is formed on the intermediate transfer belt 21.

At the time the sheet P conveyed to the space between the intermediate transfer belt 21 and the secondary transfer roller 33 passes through the space between the intermediate transfer belt 21 and the secondary transfer roller 33, the toner image formed on the intermediate transfer belt 21 is transferred onto the sheet P. As a result, a toner image formed with the yellow (Y) toner, the magenta (M) toner, the cyan (C) toner and the black (K) toner is formed on the sheet P.

The sheet P on which the toner image is formed passes through the fixing device 50. At this time, the fixing control circuit 150 controls the output from the heating coil 60 according to the size of the sheet P. The sheet P is heated at the time of passing through the fixing device 50. As a result, the toner image transferred onto the sheet P is fixed to the sheet P, and thus an image is formed on the sheet P. The sheet P on which the image is formed is discharged by the sheet discharge roller 37 to the sheet discharge section 38. In the image forming processing, the above-described processing is performed a number of times in accordance with the number of print copies.

As described above, in the fixing device 50 according to the present embodiment, the pressing roller 52 moves between the standby position shown in FIG. 10 and the abutting position shown in FIG. 11, thereby intermittently pressing the pressing pad 90 against the base member 80. In this way, the lubricant supply member 99 positioned between the base member 80 and the pressing pad 90 intermittently expands and contracts. As a result, the lubricant intermittently exudes from the lubricant supply member 99 and is then applied to the inner peripheral surface of the fixing belt 51. Therefore, a frictional force between the pressing pad 90 and the fixing belt 51 can be reduced, and a lubricating property can be maintained for a long time. As a result, smoothness of the operation of the fixing device 50 can be maintained and a device life can be extended.

Specifically, at the time of assembly of the fixing device, a sufficient amount of the lubricant such as silicone oil is applied to the inner peripheral surface of the fixing belt. However, as the fixing belt rotates, the lubricant runs short due to leakage out of the end of the fixing belt. As a result, the sliding property of the fixing belt and the pressing pad is reduced. Even if the amount of the lubricant to be applied at the time of assembly of the fixing device is increased, only the amount of the lubricant leaking out during the operation or assembly of the device is increased, but an effect in the increase of the amount of the lubricant that contributes to maintenance of the lubricating property is not achieved. In the fixing device according to the present embodiment, since the lubricant can be supplied continuously, the lubricating property of the fixing belt can be maintained for a long period of time.

In the fixing device 50 according to the present embodiment, the lubricant applied to the inner peripheral surface of the fixing belt 51 falls to the lubricant supply member 99 positioned below along the base member 80 and the support member 81 to be replenished to the lubricant supply member 99 again. In the fixing device 50, the lubricant returning to the lubricant supply member 99 is supplied to the inner peripheral surface of the fixing belt 51 again at an appropriate timing. Thereby, the lubricating property can be maintained for a longer period of time.

The image forming apparatus 10 according to the present embodiment includes the fixing device 50. Therefore, the image forming apparatus 10 can continuously form images with high accuracy.

Second Embodiment

Figure 13:
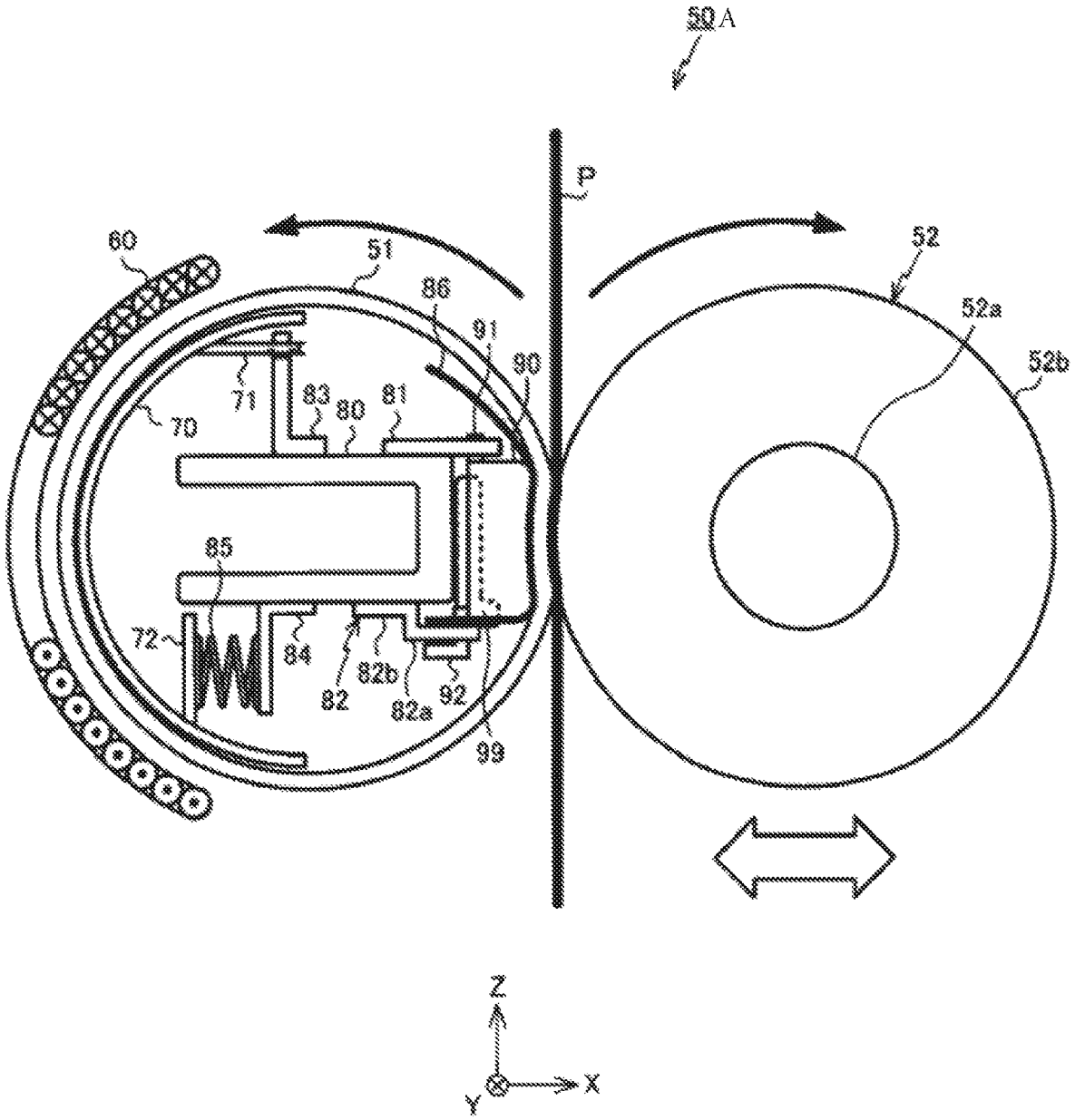
FIG. 13 is a diagram illustrating a fixing device according to a second embodiment.

Next, a fixing device 50A according to the second embodiment is described. FIG. 13 is a diagram illustrating the fixing device 50A according to the second embodiment. The difference between the fixing device 50A and the fixing device 50 according to the first embodiment is that the fixing device 50A includes a sliding sheet 86 between the pressing pad 90 and the inner peripheral surface of the fixing belt 51.

The sliding sheet 86 is made of a member excellent in sliding property, abrasion resistance and heat resistance. The sliding sheet 86 may be, for example, a glass cloth impregnated with a fluorine resin.

Figure 14:
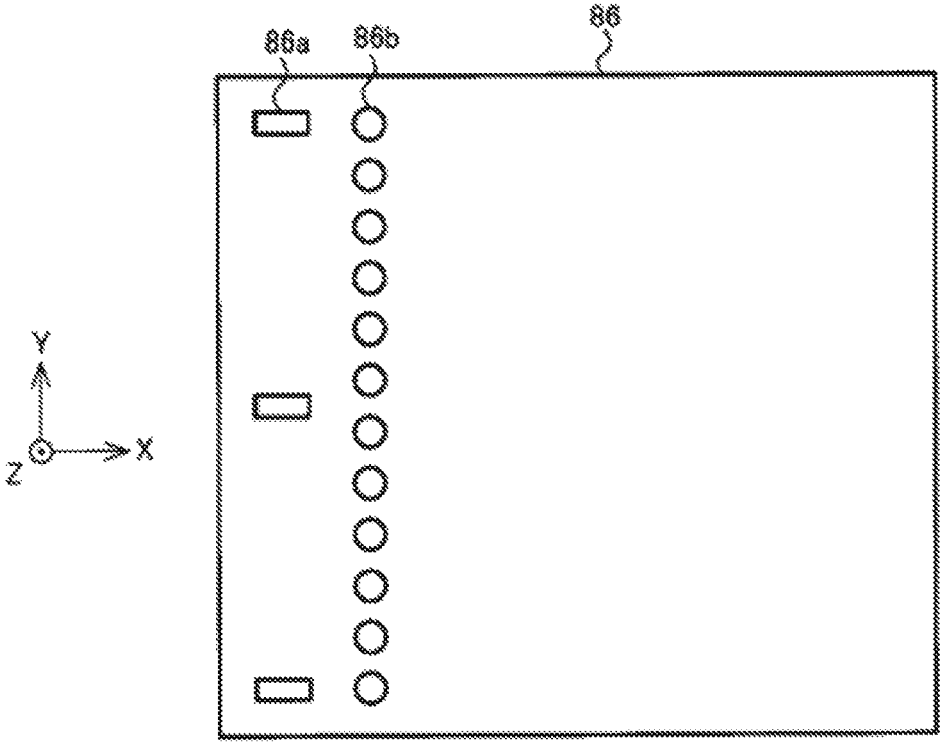
FIG. 14 is a diagram illustrating a sliding sheet.

FIG. 14 is a diagram illustrating the sliding sheet 86. As shown in FIG. 14, the sliding sheet 86 has a square shape, and has three rectangular openings 86*a* and a plurality of circular openings 86*b* at an end of the sliding sheet 86 on the −X side. For example, the openings 86*b* are arranged at equal intervals along the Y axis. The sliding sheet 86 is attached to the support member 82 for supporting the pressing pad 90.

Figure 15:
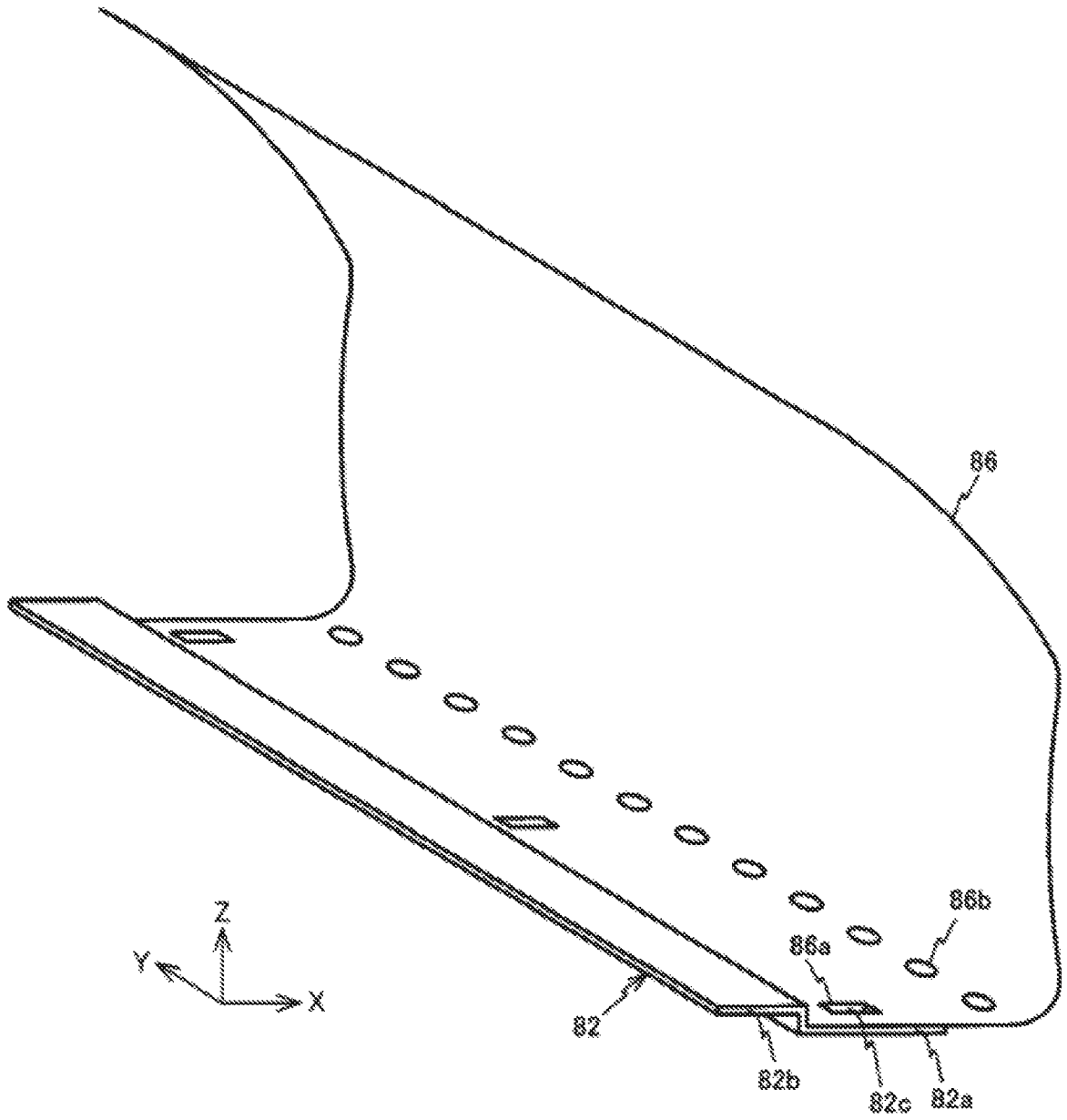
FIG. 15 is a diagram illustrating a sliding sheet attached to the support member.

FIG. 15 is a diagram illustrating the sliding sheet 86 attached to the support member 82. As shown in FIG. 15, the sliding sheet 86 is arranged in such a manner that the three openings 86*a* match the openings 82*c* of the support member 82 and is attached to the support member 82 by being bonded to the first portion 82*a* of the support member 82 by an adhesive. As shown in FIG. 13, the sliding sheet 86 is arranged between the pressing pad 90 and the fixing belt 51. As can be known with reference to FIG. 13 and FIG. 15, the opening 86*b* of the sliding sheet 86 is positioned below the pressing pad 90 and the lubricant supply member 99. Therefore, if the sliding sheet 86 is provided, the lubricant exuding from the lubricant supply member 99 is also supplied to the inner peripheral surface of the fixing belt 51 through the opening 86*b* of the sliding sheet 86.

As described above, the fixing device 50A according to the present embodiment includes the sliding sheet 86. Thus, the sliding property of the pressing pad 90 and the fixing belt 51 can be improved. Even though the pressing pad 90 is covered by the sliding sheet 86, the lubricant exuding from the lubricant supply member 99 is also supplied to the inner peripheral surface of the fixing belt 51 through the opening 86*b* of the sliding sheet 86. Therefore, the frictional force between the pressing pad 90 and the fixing belt 51 can be reduced, and the lubricating property can be maintained for a long time. By adjusting the size and position of the opening 86*b* of the sliding sheet 86, the amount of the lubricant to be supplied to the inner peripheral surface of the fixing belt 51 can be adjusted, or the position where the lubricant is supplied can also be adjusted. Therefore, the smoothness of the operation of the fixing device 50 can be maintained and the device life can be extended.

Figure 16:
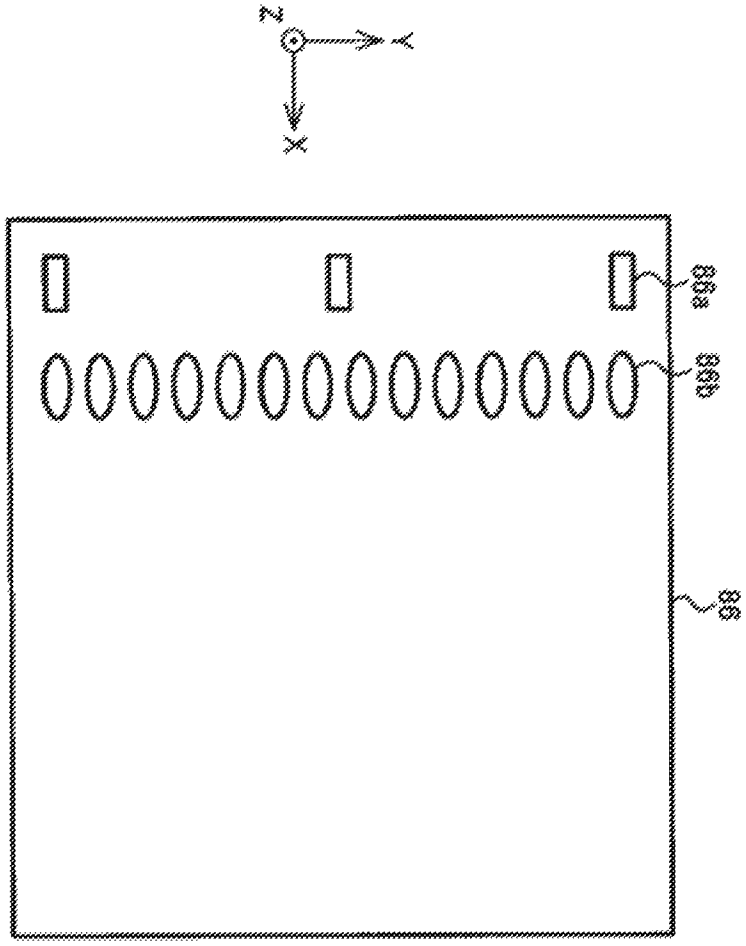
FIG. 16 is a diagram illustrating a sliding sheet according to a modification.

In the present embodiment, the sliding sheet 86 is provided with the circular opening 86*b*; however, it is not limited thereto. For example, as shown in FIG. 16, an elliptical opening 86*b* may be provided in the sliding sheet 86, or an opening having a polygonal shape such as a square shape may be provided.

The embodiments of the present invention are described above, but it is not limited thereto. For example, in the above embodiment, as shown in FIG. 6, the fixing device 50 is provided with four lubricant supply members 99. However, it is not limited thereto, and the fixing device 50 may be provided with five or more lubricant supply members 99.

The lubricant supply members 99 may be, for example, densely arranged at the center of the fixing belt 51 in consideration of the leakage of the lubricant from both ends of the fixing belt 51 to the outside. According to the structure of the image forming apparatus, the arrangement may be determined as appropriate.

In the above embodiment, the fixing belt 51 is heated by the heating coil 60 using the electromagnetic induction. However, it is not limited thereto, and the fixing belt 51 may be heated using a halogen heater, a ceramic heater, or the like.

Figure 17:
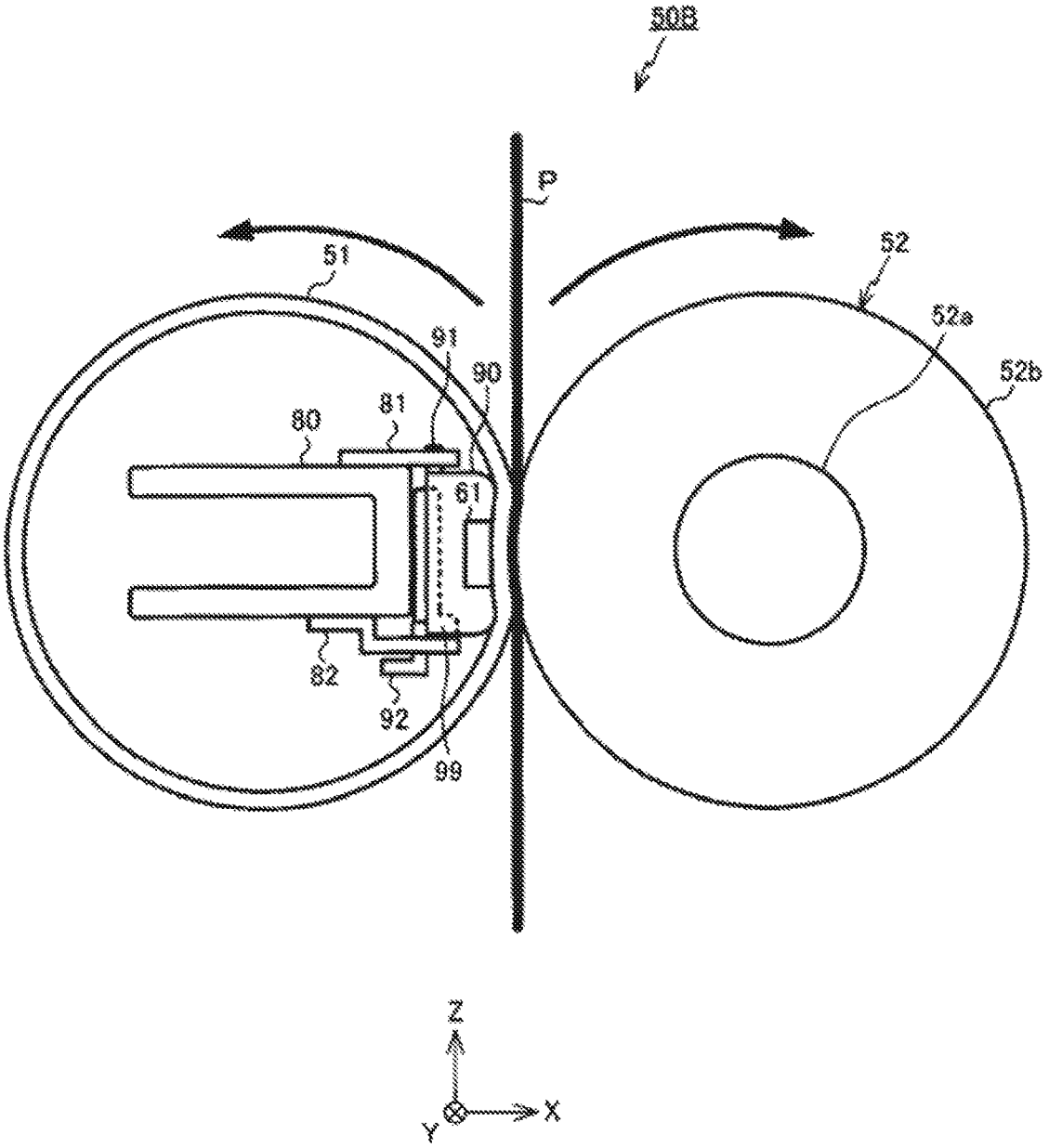
FIG. 17 is a diagram illustrating a fixing device according to a modification.

FIG. 17 is a diagram illustrating a fixing device 50B of a system in which the sheet P is heated by a heater 61 via the film-like fixing belt 51. The heater 61 includes, for example, a substrate made of ceramic and a heating section formed on the substrate. In such a fixing device 50B, the heater 61 heats the sheet P by applying heat to the sheet P via the fixing belt 51.

In the above embodiments, the fixing device 50 has the cylindrical fixing belt 51. The shape of the fixing belt 51 is not limited thereto. For example, as shown in FIG. 18, the fixing device of the image forming apparatus 10 may be a fixing device 50C provided with the fixing belt 51 stretched over a plurality of rollers.

Figure 18:
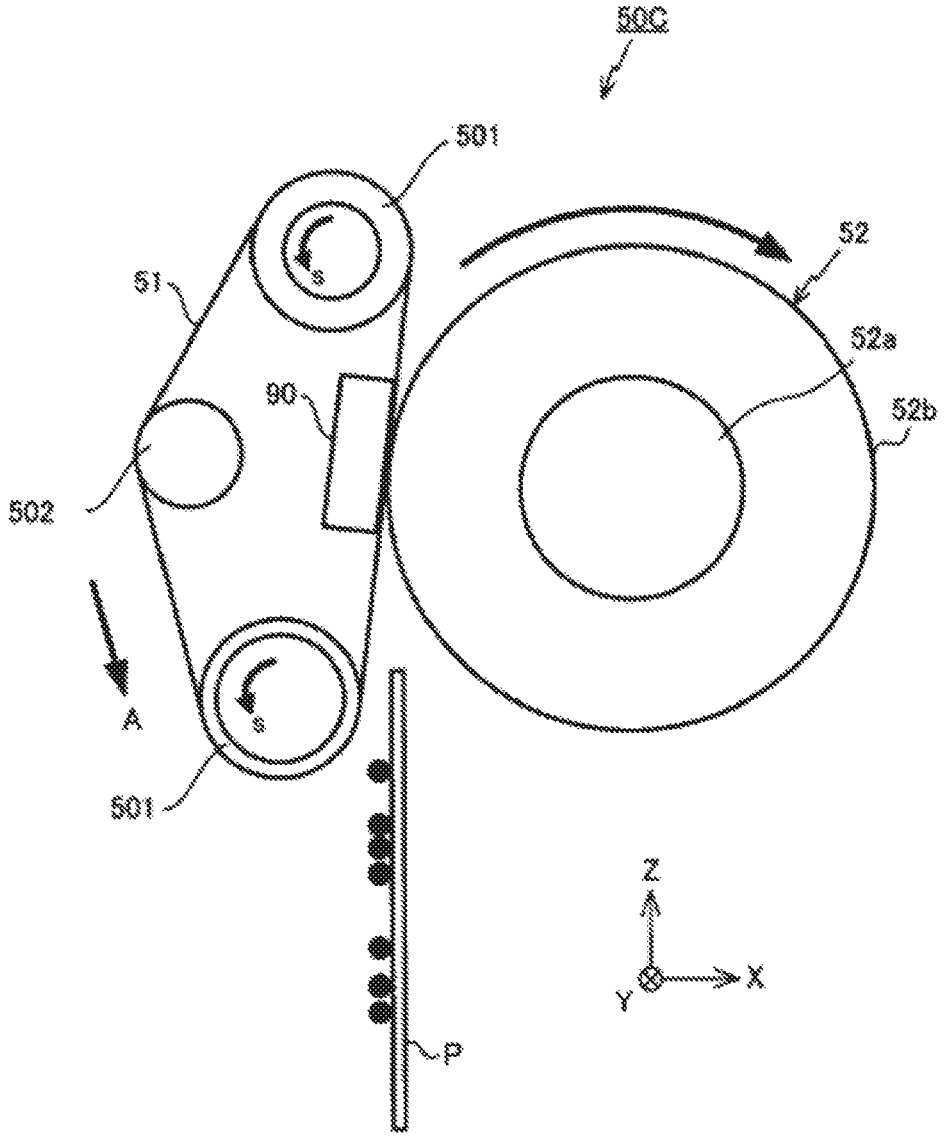
FIG. 18 is a diagram illustrating a fixing device according to another modification.

As shown in FIG. 18, in the fixing device 50C, the fixing belt 51 is stretched over drive rollers 501 for rotating the fixing belt 51 and a tension roller 502 for applying tension to the fixing belt 51. The fixing belt 51 rotates in a direction indicated by an arrow A as the drive rollers 501 rotate in a direction indicated by an arrow s.

In the fixing device 50C, the pressing roller 52 is pressed against the pressing pad 90 in contact with the inner peripheral surface of the fixing belt 51, thereby forming a nip between the fixing belt 51 and the pressing roller 52. The sheet P onto which the toner image is transferred moves upward, and in this way, the sheet P is heated at the nip. As a result, the toner image is fixed to the sheet P, and an image is formed on the sheet P.

In the above embodiments, the image forming apparatus 10 is a multifunction peripheral. However, it is not limited thereto, and the image forming apparatus 10 may be a laser printer or the like.

Other than in the operating examples, if any, or where otherwise indicated, all numbers, values and/or expressions referring to parameters, measurements, conditions, etc., used in the specification and claims are to be understood as modified in all instances by the term "about."

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A fixing device for fixing a toner image on a medium, comprising:

a heating rotating member that is rotatably supported;

a heater configured to heat the heating rotating member;

a pressing member arranged at an inside of the heating rotating member and configured to abut against an inner peripheral surface of the heating rotating member;

a pressing rotating member configured to be pressed against the pressing member across the heating rotating member, the pressing rotating member and the heating rotating member forming a nip through which the medium passes;

a support member configured to movably support the pressing member in a direction orthogonal to a rotation axis of the pressing rotating member;

a lubricant supply member arranged between the support member and the pressing member, the lubricant supply member impregnated with a lubricant; and a sliding sheet arranged between the pressing member and the heating rotating member and having an opening on an upstream side in a rotation direction of the heating rotating member.

2. The fixing device according to claim 1, wherein a recess is formed on an opposite surface of the pressing member facing the support member, and the lubricant supply member is arranged in the recess.

3. The fixing device according to claim 2, wherein a thickness of the lubricant supply member in a direction orthogonal to the opposite surface is larger than a depth of the recess.

4. The fixing device according to claim 1, further comprising:

a support module configured to movably support the pressing rotating member between a first position where the pressing rotating member presses the heating rotating member and a second position where the pressing rotating member is separated from the heating rotating member.

5. The fixing device according to claim 1, wherein the heating rotating member comprises a base material, a heat generating layer, a multifunctional layer, an elastic layer, and a protective layer.

6. The fixing device according to claim 1, wherein the pressing member comprises a pressing pad made of an elastic material.

7. The fixing device according to claim 1, wherein the lubricant supply member comprises an elastically deformable quadrangular plate-like member.

8. The fixing device according to claim 1, wherein the lubricant supply member is bonded from a bottom wall surface of the recess to a lower surface of the pressing member with an adhesive.

9. The fixing device according to claim 1, wherein the lubricant supply member comprises a liquid absorbent material and impregnated with silicone oil.

10. An image forming apparatus, comprising:

a toner image forming module configured to form a toner image;

a transfer member configured to transfer the toner image onto a medium; and a fixing device configured to heat the medium on which the toner image is transferred by the transfer member to fix the toner image to the medium, wherein the fixing device comprises:

a heating rotating member that is rotatably supported;

a heater configured to heat the heating rotating member;

a pressing member arranged at an inside of the heating rotating member and configured to abut against an inner peripheral surface of the heating rotating member;

a pressing rotating member configured to be pressed against the pressing member across the heating rotating member, the pressing rotating member and the heating rotating member forming a nip through which the medium passes;

a support member configured to movably support the pressing member in a direction orthogonal to a rotation axis of the pressing rotating member;

a lubricant supply member arranged between the support member and the pressing member, the lubricant supply member impregnated with a lubricant; and a sliding sheet arranged between the pressing member and the heating rotating member and having an opening on an upstream side in a rotation direction of the heating rotating member.

11. The image forming apparatus according to claim 10, wherein a recess is formed on an opposite surface of the pressing member facing the support member, and the lubricant supply member is arranged in the recess.

12. The image forming apparatus according to claim 11, wherein a thickness of the lubricant supply member in a direction orthogonal to the opposite surface is larger than a depth of the recess.

13. The image forming apparatus according to claim 10, further comprising:

a support module configured to movably support the pressing rotating member between a first position where the pressing rotating member presses the heating rotating member and a second position where the pressing rotating member is separated from the heating rotating member.

14. The image forming apparatus according to claim 10, wherein the heating rotating member comprises a base material, a heat generating layer, a multifunctional layer, an elastic layer, and a protective layer.

15. The image forming apparatus according to claim 10, wherein the pressing member comprises a pressing pad made of an elastic material.

16. The image forming apparatus according to claim 10, wherein the lubricant supply member comprises an elastically deformable quadrangular plate-like member.

17. The image forming apparatus according to claim 10, wherein the lubricant supply member is bonded from a bottom wall surface of the recess to a lower surface of the pressing member with an adhesive.

18. The image forming apparatus according to claim 10, wherein the lubricant supply member comprises a liquid absorbent material and impregnated with silicone oil.

19. An image forming apparatus, comprising:

a toner image forming module configured to form a toner image;

a transfer member configured to transfer the toner image onto a medium; and a fixing device configured to heat the medium on which the toner image is transferred by the transfer member to fix the toner image to the medium, wherein the fixing device comprises:

a heating rotating member that is rotatably supported;

a heater configured to heat the heating rotating member;

a pressing member arranged at an inside of the heating rotating member and configured to abut against an inner peripheral surface of the heating rotating member;

a pressing rotating member configured to be pressed against the pressing member across the heating rotating member, the pressing rotating member and the heating rotating member forming a nip through which the medium passes;

a support member configured to movably support the pressing member in a direction orthogonal to a rotation axis of the pressing rotating member; and a lubricant supply member arranged between the support member and the pressing member, the lubricant supply member impregnated with a lubricant, wherein the lubricant supply member is bonded from a bottom wall surface of the recess to a lower surface of the pressing member with an adhesive.

20. The image forming apparatus according to claim 19, further comprising:

a sliding sheet arranged between the pressing member and the heating rotating member and having an opening on an upstream side in a rotation direction of the heating rotating member.

* * * * *